US007029143B2

(12) United States Patent
Kiechle et al.

(10) Patent No.: US 7,029,143 B2
(45) Date of Patent: Apr. 18, 2006

(54) LIGHT COVE

(75) Inventors: Albert Kiechle, Downey, CA (US); Lester Eisner, Lakewood, CA (US)

(73) Assignee: Ceilings Plus, Los Angeles, CA (US)

( * ) Notice: Subject to any disclaimer, the term of this patent is extended or adjusted under 35 U.S.C. 154(b) by 0 days.

(21) Appl. No.: 10/690,482

(22) Filed: Oct. 21, 2003

(65) Prior Publication Data

US 2004/0136182 A1 Jul. 15, 2004

Related U.S. Application Data

(60) Provisional application No. 60/420,377, filed on Oct. 22, 2002.

(51) Int. Cl.
*F21S 8/00* (2006.01)

(52) U.S. Cl. ..... 362/147; 362/236; 362/432

(58) Field of Classification Search ..... 362/145–151, 362/404, 431, 433, 436, 438–439, 457, 236, 362/432

See application file for complete search history.

(56) References Cited

U.S. PATENT DOCUMENTS 2,569,518 A * 10/1951 Deutsch et al. ..... 362/151
2,986,627 A * 5/1961 Marriett ..... 362/151
4,088,881 A * 5/1978 Neer et al. ..... 362/223
4,186,538 A * 2/1980 Marcum, Jr. ..... 52/521
4,251,855 A * 2/1981 Radek ..... 362/151
4,406,435 A * 9/1983 Anderson ..... 248/261
4,533,981 A * 8/1985 Radek ..... 362/151
4,725,931 A * 2/1988 Bourdon ..... 362/151
5,331,526 A * 7/1994 Girot et al. ..... 362/147
5,381,320 A * 1/1995 Jordan ..... 362/147
5,720,540 A * 2/1998 Crown et al. ..... 362/92
5,931,426 A * 8/1999 Heckner ..... 248/220.21
D489,472 S * 5/2004 Newhouse et al. ..... D26/75

* cited by examiner

*Primary Examiner*—Stephen Husar
*Assistant Examiner*—Jason Han
(74) *Attorney, Agent, or Firm*—Lewis B. Sternfels

(57) ABSTRACT

A light cove (20), which is adapted to be secured to a wall (46), includes elongated top and bottom fastening devices (22) and (24), a light-transparent panel section (26), and a plurality of two-piece adjustable supports (28). A light fixture (82) with one or more bulbs (80) is positioned intermediate to the top and bottom fastening devices, and all three elements are separately securable to a wall (46) for accommodating any unevenness of the wall and to provide maximum adjustment among the three parts. The panel section is pivotally couplable to the bottom fastening device and can be articulated upwardly so as to position its end (50) adjacent to the adjustable supports. The supports include a strap (62) having projections (78) which can be snapped past a snap-in lip (58) to form a secure joint between the strap and the panel section. After proper positioning of the panel section with respect to the wall and its surroundings, a plurality of screw and wing nut couplings (66) in the adjustable supports are fully tightened to complete the installation of light cove. When it is necessary to change the bulbs or clean or replace any parts of the panel section or the light fixture, it is only necessary to reverse the above-described installation.

10 Claims, 4 Drawing Sheets

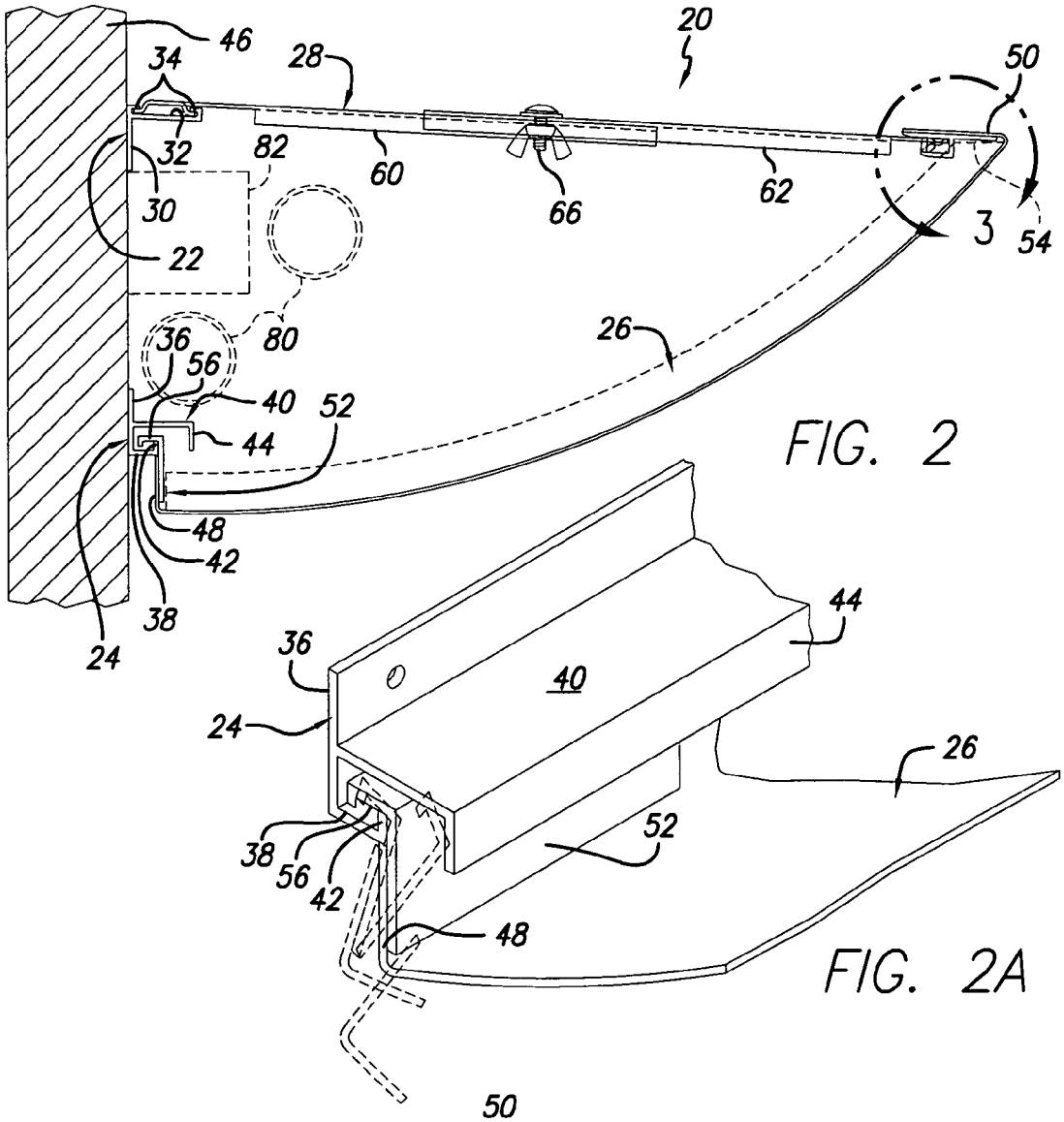
FIG. 2
FIG. 2A
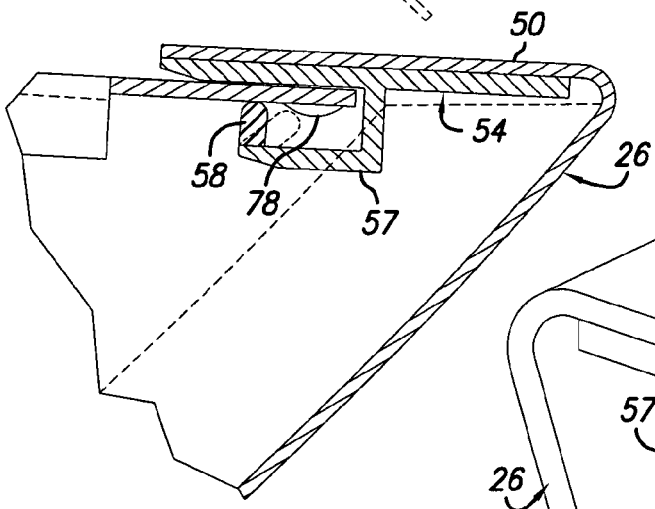
FIG. 3
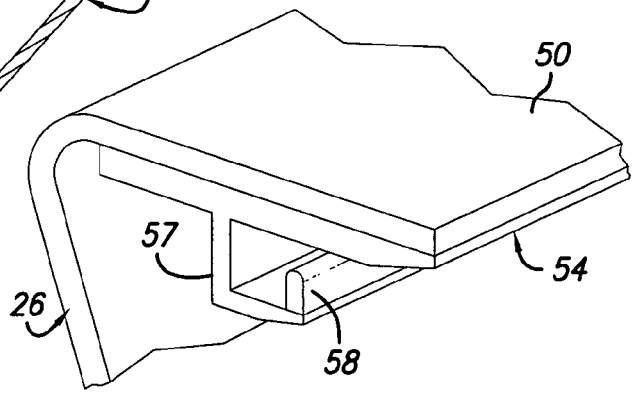
FIG. 3A

LIGHT COVE

CROSS-REFERENCE TO RELATED APPLICATION

This application claims the benefit of U.S. Provisional Application No. 60/420,377, filed 22 Oct. 2002.

REFERENCE REGARDING FEDERAL SPONSORSHIP

Not Applicable

REFERENCE TO MICROFICHE APPENDIX

Not Applicable

BACKGROUND OF THE INVENTION

1. Field of the Invention

The present invention relates to a light cove and, in particular, to improvements in securing a light fixture and its shrouding structure to a wall.

2. Description of Related Art and Other Considerations

Known light cove assemblies include an integrated electrical and structural construction which requires separate installation of the electrical and structural components. The electrical work is generally first made into a wall, followed by placement of rails onto the wall. A shroud structure is then secured to the rails over at least a portion of the electrical component. Further electrical work may be needed. Coordination and other problems occur because the electrical and structural work is not integrated but performed separately, and it is not infrequent that both electrical and non-electrical work cannot be scheduled at the same time. Therefore, errors can arise and rework is needed. When a fluorescent or other light bulb burns out, it is generally not easy to replace the bulb because of the integrated structural and electrical installation; therefore, a more skilled worker may be required, possibly resulting in additional scheduling and cost problems. Furthermore, because the structural parts are so fabricated as a unit, it may become an installation problem or, at least, difficulties may be experienced when the wall, to which the fixture is to be attached, is uneven. Also, existing assembles often permit stray light to escape from the assembly.

The assembly is not amenable to providing for changes in aesthetic appearance or for incorporation of other features, such as acoustic materials because of its unitary and integrated electrical and structural construction.

SUMMARY OF THE INVENTION

These and other problems are successfully addressed and overcome by the present invention. Either the structural parts or the electrical parts may be first secured to the wall, and a panel section including the shroud is then placed onto the structural parts. Specifically, top and bottom spaced-apart fastening devices are separately secured to the wall. A panel section is pivotally secured preferably to the bottom fastening device by a hinge arrangement, and to the top fastening device by an adjustable support. A simple engaging and disengaging connection between the panel section and the adjustable support enables the panel section to be easily disengaged from the adjustable support so that the panel section can be downwardly pivoted with respect to the bottom fastening device. The shroud is amenable to the inclusion of decorative and acoustic control material and other features.

Several advantages are derived from this arrangement. The installation is easily made. Scheduling of the electrical and the structural workers need not be coordinated at exactly the same time, thereby avoiding conflict between the electrical and non-electrical work. Because the top and the bottom fastening devices are separate, problems relating to uneven walls are minimized. Placement and replacement of light bulbs is simplified; pivoting of the panel section provides easy access to the light fixture. In general, costs are reduced.

Other aims and advantages, as well as a more complete understanding of the present invention, will appear from the following explanation of an exemplary embodiment and the accompanying drawings thereof.

BRIEF DESCRIPTION OF THE DRAWINGS

FIG. 2 is side view of the embodiment depicted in FIG. 1 showing a light-sealing, pivotal attachment of the panel section to a wall at its wall end;

FIG. 2A is an enlarged perspective view of the light cove of FIGS. 1 and 2, illustrating the pivotal articulation of the panel section;

FIG. 3 is an enlarged view of a supporting snap-in mechanism enabling attachment of the outwardly extending end of the panel section shown in FIG. 2 to a two-piece adjustable wall support;

FIG. 3A is a perspective view of the supporting snap-in attachment, per se, depicted in FIG. 3;

DETAILED DESCRIPTION OF THE PREFERRED EMBODIMENTS

Figure 1:
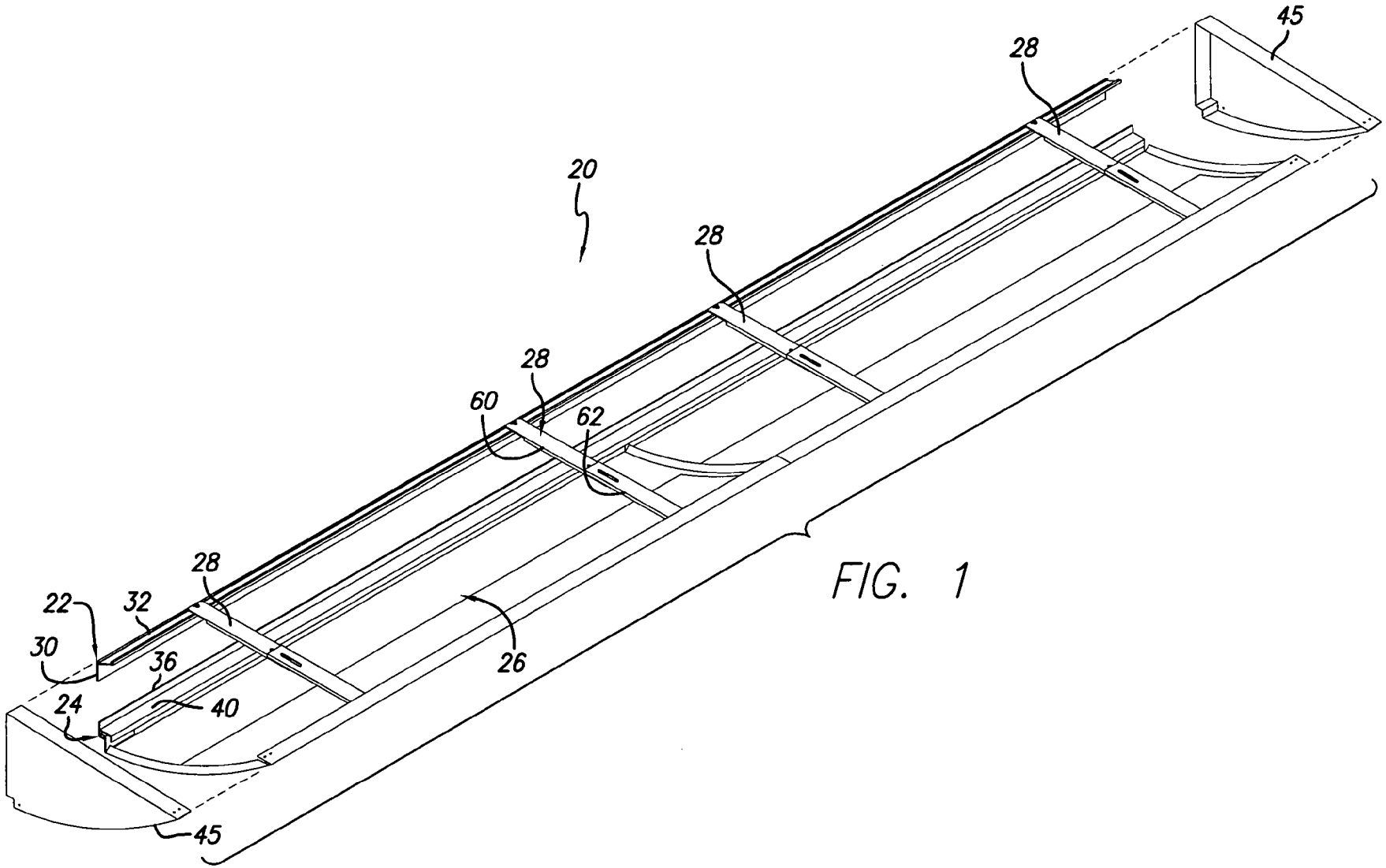
FIG. 1 is a perspective view of a preferred embodiment of the present invention characterized as a light cove including a panel section having a wall end and an end extending outwardly from the wall end.

Accordingly, a light cove 20 includes separate elongated top and bottom fastening devices 22 and 24, a light-transparent panel or shroud section 26, and a plurality of two-piece adjustable supports 28. Top fastening device 22 includes a backing plate 30 and a channel 32 extending perpendicularly therefrom. As best depicted in FIGS. 2 and 2A, channel 32 has a generally U-shaped configuration with a pair of rails 34 extending towards one another. Bottom fastening device 24 includes a backing plate 36, a channel 38 and an overhang 40, both of which extend perpendicularly from backing plate 36. Channel 38 has a generally U-shaped configuration with an upwardly extending rail 42. Overhang 40 has a downwardly extending portion 44 which is disposed to hang over U-shaped channel 38. Both fastening devices 22 and 24 may be formed of extruded aluminum stock. Panel section 26 may comprise a construction including a light-transparent or translucent material which additionally may be modified to have sound-absorbing acoustic properties.

A pair of end caps 45 seal the light cove at its ends and act both as an aesthetic closure as well as a light seal.

The light cove is disposed to be secured to a wall 46 (see FIG. 2) by securing fastening device backing plates 30 and 36 individually thereto by appropriate means, such as by screws and bolts. The separateness of top and bottom fastening devices 22 and 24 permits cove 20 to compensate for walls that may not be uniformly smooth or even. Thus, for example, compensating material or the like may be placed between either or both of backing plates 30 and 36 and the wall to effect a parallel disposition between the top and bottom fastening devices. Further, the separateness of the fastening devices permit them to be precisely spaced from one another to accommodate the remainder of the light cove components, including the electrical fixture.

Panel section 26 extends from wall 46 in an upwardly curved manner from a wall end 48 and an end 50 extending outwardly from the wall end. An extended hanger 52 and an attaching fixture 54 are bonded or otherwise secured to respective ends 48 and 50. A hooked end 56 terminates hanger 52. Hanger 52 and U-shaped channel 38 may be construed as forming an interleaved hinged construction. Attaching fixture 54 includes an L-shaped connector 57 and an elongated snap-in lip 58 terminating connector 57. Snap-in lip 58 is disposed to be deformable, while the remainder of attaching fixture is rigid.

Adjustable support 28 (see FIGS. 2 and 4–11) is utilized to secure panel section 26 at its end 50 to top fastening device 22 and, thereby, to wall 46. Support 28 comprises a pair of telescoping straps 60 and 62, having longitudinally extending aligned holes 64 therein, and the straps are secured together by a screw and wing nut coupling 66.

Figure 5:
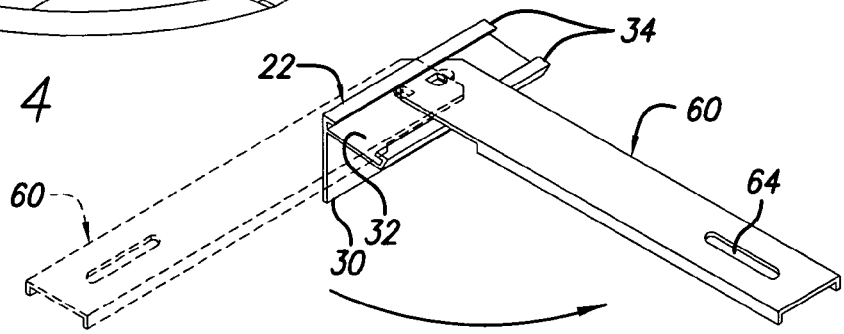
FIGS. 5–10 are views of the first strap of the two-piece adjustable supports for providing its connection to a wall-securing top fastening device, with FIG. 5 illustrating a perspective view of the first strap of the two-piece adjustable supports and, in phantom, of the method of fastening it to the top fastening device, and with FIGS. 6–10 respectively illustrating perspective, top end, side and bottom views of the first strap of the two-piece adjustable supports.
Figure 6:
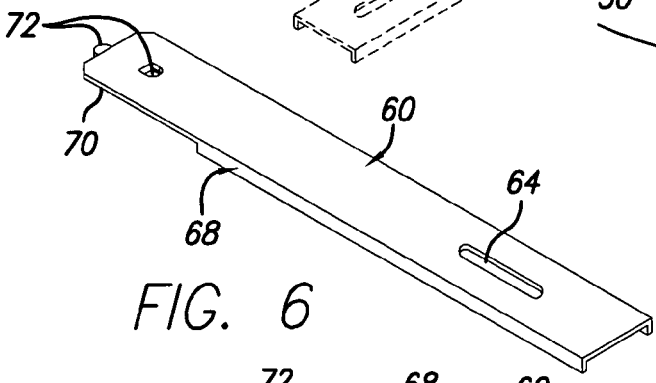
Figure 7:
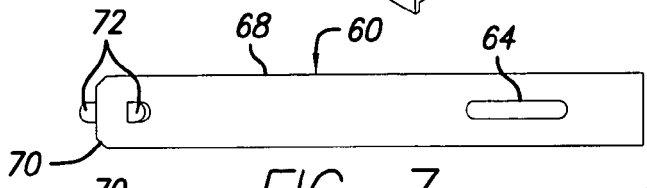
Figure 8:
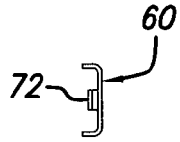
Figure 9:
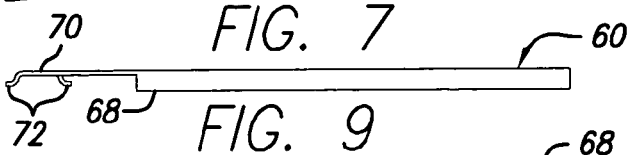
Figure 10:
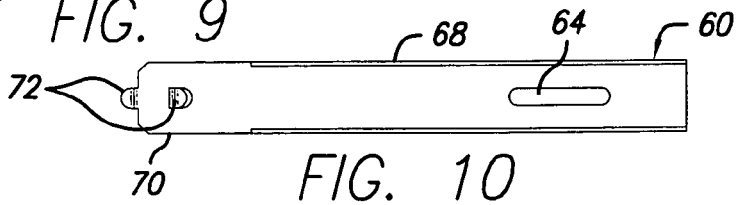
Figure 11:
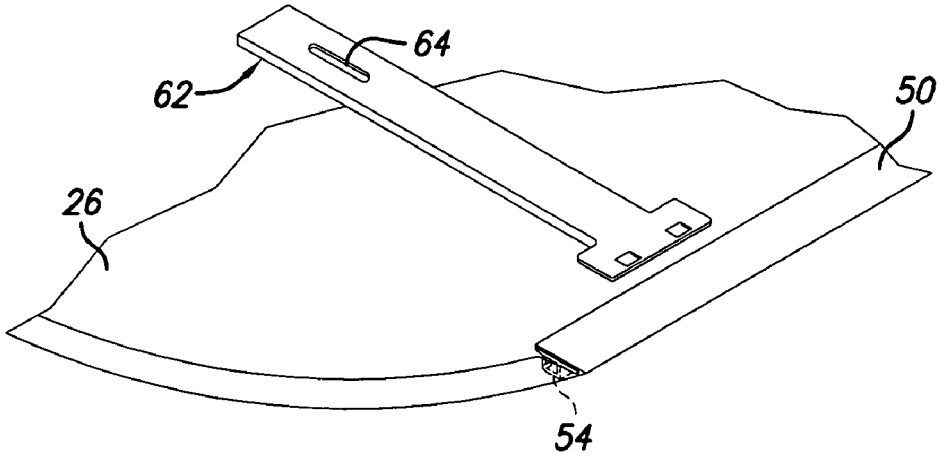
FIGS. 11–15 are views of the second strap of the two-piece adjustable supports respectively showing it in perspective and from its top, end and side.
Figure 12:
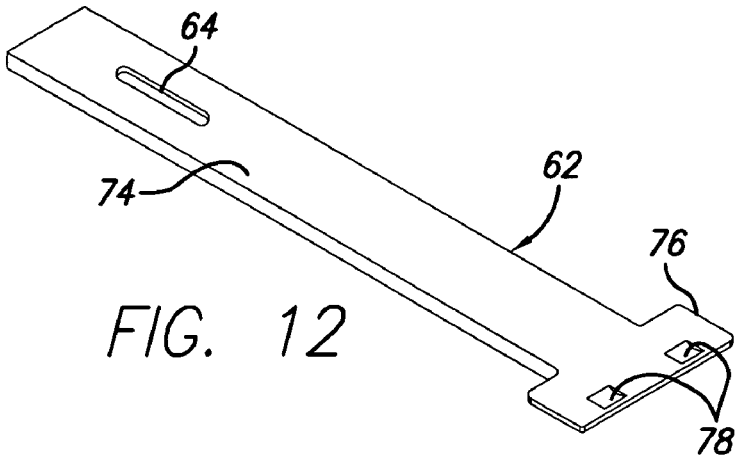
Figure 13:
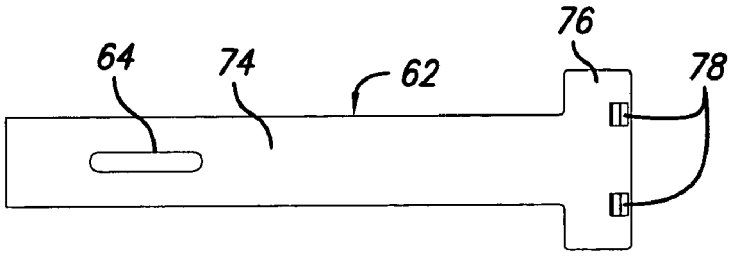
Figure 14:
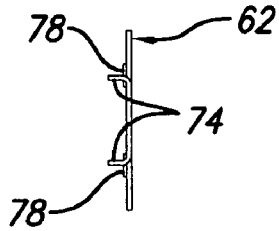
Figure 15:
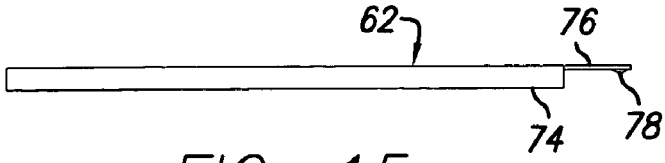

As best illustrated in FIGS. 6–10, strap 60 comprises a U-shaped portion 68, in which its longitudinally extending hole is located, and a terminus 70 in which a pair of oppositely directed tangs 72 are formed. As shown in FIG. 5, strap 60 is secured to top fastening device 30, within its rails 34, by positioning strap 60 parallel to the top fastening device and then by turning strap 60 perpendicularly thereto to position and lock the tangs under rails 34.

As best shown in FIGS. 11–15, strap 62 comprises a U-shaped portion 74, in which its longitudinally extending hole 64 is located, and a terminus 76 in which a pair of spaced apart, downwardly directed projecting bumps 78 are formed. As shown in FIG. 3, projecting bumps 78 are disposed to pass over and temporarily deform snap-in lip 58 to secure strap 62 to panel section 26 and, thereby, to form a support between the panel section at its end 50 to top fastener 22. Because the purpose of bumps 78 is to provide a snug fit, they may take any configuration which effects such a snug fit.

Figure 4:
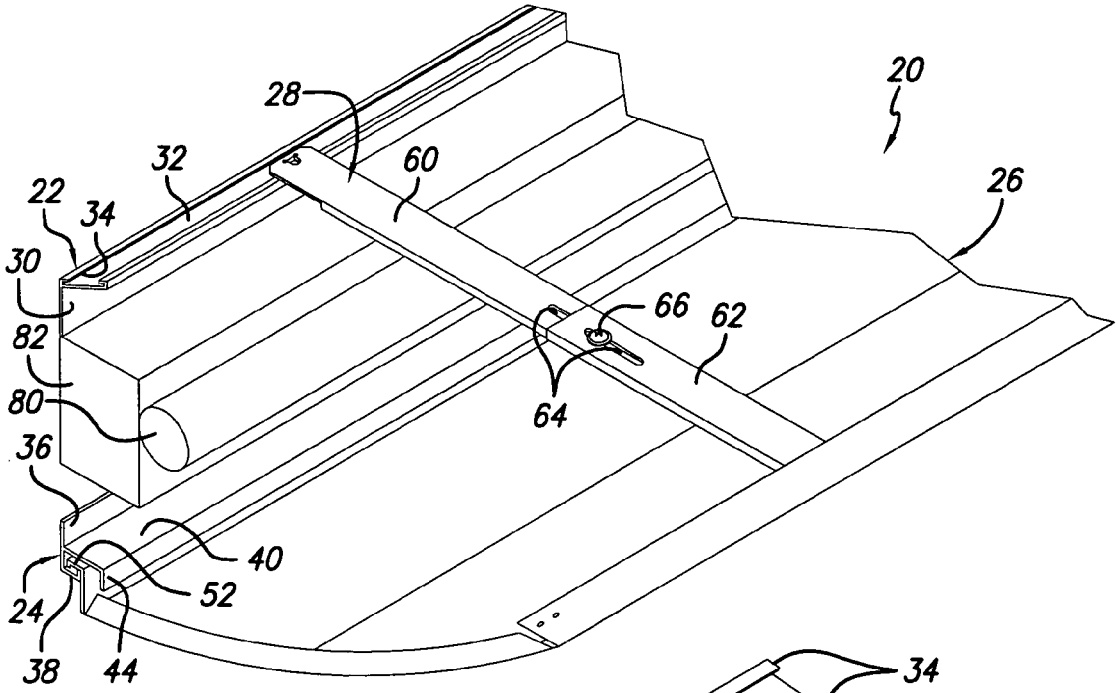
FIG. 4 is a view of an end of the light cove including one of several two-piece adjustable supports utilizing a pair of straps, similar to that illustrated in FIG. 2, but in perspective.

Light cove 20 is completed with a pair of fluorescent bulbs 80 or the like and a ballast 82, as illustrated in FIGS. 2 and 4. These electrical fixtures, being separate from top and bottom fastening devices 22 and 24, permit flexibility both in the type of electrical fixture desired as well as in its placement with respect to the fastening devices.

The light cove is assembled and dissembled, as follows. Top and bottom fastening devices 22 and 24 are secured to wall 46 in any appropriate manner, such as by screws and bolts. The electrical fixture is then secured to the wall. Alternatively, the light fixture may be first secured in place, followed by the fastening devices. This permits flexibility in scheduling the electrical and structural work. Bulbs 80 are installed now or, if desired, later.

In either case, panel 26 is first attached to the bottom fastening device and then to the top fastening device in the following manner. Panel 26 is manipulated or articulated, as shown in FIG. 2A, to position hooked terminus 56 of hanger 52 onto channel 38 of bottom fastening device 24. Strap 60 of adjustable support 28 is inserted into and locked to top fastening device 22 as shown in FIG. 5 from a parallel to a perpendicular disposition with respect to channel rails 34 of the top fastening device; however, if desired, this step may have been completed before the panel section has been coupled to bottom fastening device 24. In addition, strap 62 may be then be loosely coupled to strap 60 or, beforehand, have been so coupled to strap 60, through the use of screw and wing nut coupling 66 placed through longitudinally extending holes 64 to form a less than fully tightened connection between the straps.

Regardless of the specific timing of the coupling of adjustable support 28, panel 26 is then pivoted upwardly so as to position its end 50 adjacent to strap 62 and its projections 78. Projections 78 are then snapped past snap-in lip 58 to form a secure joint between strap 62 and panel section 26. After proper positioning of the panel section vis-a-vis wall 46 and its surroundings, screw and wing nut coupling 66 is then fully tightened to complete the installation of light cove 20. When it is necessary to change the bulbs or clean or replace any parts of panel section 26 or even the light fixture, it is only necessary to reverse the above-described installation.

When the bulbs in the light cove are energized, light passes through panel section 26, but is shielded from passing through the bottom fastening device, both by the interleaved connection between hooked terminus 56 and channel 38, and by the overlapping shielding of overhang 40 and its downwardly extending portion 44.

Although the invention has been described with respect to a particular embodiment thereof, it should be realized that various changes and modifications may be made therein without departing from the spirit and scope of the invention.

What is claimed is:

1. A light cove adapted to be secured to a wall comprising:

top and bottom spaced-apart fasteners each separately secured to the wall for enabling relative positioning of said top and bottom fasteners with respect to one another both to provide a maximum ability to establish any desired positioning therebetween and for accommodating any unevenness that may exist in the wall;

a panel section having a wall end and an end extending outwardly from the wall end;

an attachment securing said wall end to said bottom fastener;

a support secured to said top fastener and to said panel section outwardly-extending end for securing said panel section to said top fastener, in which said support comprises a pair of straps telescoped together to provide adjustability thereto and a device for securing said straps together.

2. A light cove according to claim 1 in which said top fastener includes an elongated channel and a first of said straps includes a pair of tangs which are adapted to extend into said elongated channel for enabling engagement of said tangs with said channel.

3. A light cove according to claim 1 further including a latching device coupled to a second of said straps and to said panel section outwardly-extending end for enabling latching of said second strap to said panel section outwardly-extending end.

4. A light cove according to claim 3 in which said latching device comprises:

a U-shaped appendage secured to said panel section outwardly-extending end and having an elongated flexible lip; and said second strap includes at least one projecting bump disposed for snapping over said lip and into said U-shaped appendage.

5. A light cove according to claim 4 in which said second strap including at least one projecting bump includes two spaced apart projecting bumps.

6. A light cove according to claim 4 in which said attachment comprises a hinge attachment for enabling said panel section to be pivoted with respect to said bottom fastener in the absence of when said panel section is secured to said top fastener.

7. A light cove according to claim 6 in which said hinge attachment comprises:

an upwardly extending articulation member coupled to said bottom fastener; and a downwardly extending articulation member coupled to said panel section wall end and extending into said upwardly extending articulation.

8. A light cove according to claim 6 in which said hinge attachment comprises a pair of U-shaped channels respectively formed on said bottom fastener and secured to said panel section wall end, and in which said upwardly and downwardly extending articulation members are members respectively of U-shaped channels, said U-shaped channels further providing a fight seal.

9. A light cove according to claim 8 further including an overhang positioned adjacent to said U-shaped channels to provide an additional light seal.

10. A light cove adapted to be secured to a wall comprising:

a panel section having a wall end and an end extending outwardly from the wall end;

top and bottom elongated spaced-apart fasteners each adapted to be separately secured to the wall;

an elongated downwardly extending U-shaped channel secured to said wall end;

said bottom fastener including an elongated, upwardly extending U-shaped channel adapted to be coupled to said elongated downwardly extending U-shaped channel for enabling said panel section to be pivoted with respect to said bottom fastener in the absence of when said panel section is secured to said top fastener, and comprising a pair of U-shaped channels respectively formed on said bottom fastener and secured to said panel section wall end, and respectively including upwardly and downwardly extending articulation members extending into their respective channels;

a light shield positioned between said top and bottom fasteners and adjacent to said U-shaped channels to form therewith a light seal;

a support secured to said top fastener and to said panel section outwardly-extending end for securing said panel section to said top fastener, including a pair of longitudinally extending straps telescoped together to provide adjustability to said support, and a device for securing said straps together;

said top fastener including an elongated channel;

a first of said straps including a pair of opposite directed tangs extending longitudinally with respect to said first of said straps, which tangs are adapted to extend into said elongated top fastener channel when said first of said straps is pivoted from being parallel to said top fastener channel to being perpendicular thereto, for enabling engagement of said tangs with said channel;

a latching device coupled to a second of said straps and to said panel section outwardly-extending end for enabling latching of said second strap to said panel section outwardly-extending end, in which said latching device comprises a U-shaped appendage secured to said panel section outwardly-extending end and having an elongated flexible lip, and a pair of projecting bumps in said second strap disposed for deforming and snapping over said lip and into said U-shaped appendage; and a light fixture having at least one light bulb adapted to be secured to the wall and positionable between said top and bottom fasteners, said light fixture being accessible for servicing and replacement of the light bulb when said panel section is pivoted with respect to said bottom fastener in the absence of when said panel section is secured to said top fastener, and said top fastener, said bottom fastener and said light fixture being disposed for attachment only to the wall for enabling relative positioning thereof with respect to one another both to provide a maximum ability to establish any desired positioning thereamongst and for accommodating any unevenness of the wall.

* * * * *